US009745534B2

(12) United States Patent
Aoki

(10) Patent No.: US 9,745,534 B2
(45) Date of Patent: Aug. 29, 2017

(54) SHOCK ABSORBER OIL COMPOSITION

(71) Applicant: IDEMITSU KOSAN CO., LTD., Chiyoda-ku (JP)

(72) Inventor: Aya Aoki, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 15/014,207

(22) Filed: Feb. 3, 2016

(65) Prior Publication Data

US 2016/0152918 A1 Jun. 2, 2016

Related U.S. Application Data

(63) Continuation of application No. 14/373,783, filed as application No. PCT/JP2012/082428 on Dec. 13, 2012, now abandoned.

(30) Foreign Application Priority Data

Jan. 31, 2012 (JP) ..... 2012-018842

(51) Int. Cl.

| | |
|---|---|
| ***C10M 169/04*** | (2006.01) |
| ***C10M 137/08*** | (2006.01) |
| ***C10M 133/16*** | (2006.01) |
| ***C10M 141/10*** | (2006.01) |
| ***C10M 101/02*** | (2006.01) |
| ***C10M 137/02*** | (2006.01) |

(52) U.S. Cl.

CPC ..... *C10M 169/04* (2013.01); *C10M 101/02* (2013.01); *C10M 133/16* (2013.01); *C10M 137/02* (2013.01); *C10M 137/08* (2013.01); *C10M 141/10* (2013.01); *C10M 2203/1006* (2013.01); *C10M 2209/084* (2013.01); *C10M 2215/08* (2013.01); *C10M 2215/28* (2013.01); *C10M 2219/044* (2013.01); *C10M 2219/046* (2013.01); *C10M 2223/04* (2013.01); *C10M 2223/043* (2013.01); *C10M 2223/049* (2013.01); *C10N 2210/02* (2013.01); *C10N 2230/06* (2013.01); *C10N 2240/08* (2013.01)

(58) Field of Classification Search

CPC ..... C10M 137/08; C10M 101/02; C10M 133/16; C10M 137/02; C10M 141/10; C10M 169/04; C10M 2203/1006; C10M 2209/084; C10M 2215/08; C10M 2215/28; C10M 2219/044; C10M 2219/046; C10M 2223/043; C10M 2223/049; C10N 2210/02; C10N 2230/06; C10N 2240/08

USPC ..... 508/437

See application file for complete search history.

(56) References Cited

U.S. PATENT DOCUMENTS

| | | | | |
|---|---|---|---|---|
| 4,634,543 | A * | 1/1987 | Okada | C10M 141/10 188/322.5 |
| 4,704,216 | A | 11/1987 | Hata | |
| 5,750,477 | A | 5/1998 | Sumiejski et al. | |
| 6,051,536 | A | 4/2000 | Igarashi et al. | |
| 2004/0198617 | A1* | 10/2004 | Kinoshita | C10M 169/06 508/527 |
| 2010/0009878 | A1 | 1/2010 | Baba et al. | |
| 2010/0075877 | A1* | 3/2010 | Koga | C10M 141/10 508/436 |
| 2011/0152143 | A1 | 6/2011 | Toda | |
| 2012/0245068 | A1* | 9/2012 | Scanlon | C10M 145/14 508/469 |
| 2014/0378358 | A1 | 12/2014 | Aoki | |

FOREIGN PATENT DOCUMENTS

| | | | |
|---|---|---|---|
| CN | 1091152 | A | 8/1994 |
| CN | 101517055 | A | 8/2009 |
| JP | 10-306292 | A | 11/1998 |
| JP | 2000 119677 | | 4/2000 |
| JP | 2005 255715 | | 9/2005 |
| JP | 2007 9200 | | 1/2007 |
| WO | WO 2009/150900 | A1 | 12/2009 |

OTHER PUBLICATIONS

Office Action mailed Feb. 5, 2016 in co-pending U.S. Appl. No. 14/373,783.

International Search Report Issued Mar. 19, 2013 in PCT/JP12/082428 Filed Dec. 13, 2012.

Extended European Search Report issued Sep. 17, 2015 in Patent Application No. 12867203.7.

Combined Chinese Office Action and Search Report issued Aug. 25, 2015 in Patent Application No. 201280068509.9 (with English translation of categories of cited documents).

Chen Hui-qing, et al., "Development of Automatic Transmission Fluid and Its Formula Selection" Automobile Technology & Material, 2005, pp. 29-34 (with English Abstract).

Combined Chinese Office Action and Search Report issued Feb. 5, 2016 in Patent Application No. 201280068509.9 (with English language translation).

Office Action mailed Jun. 30, 2016 in U.S. Appl. No. 14/373,783.

* cited by examiner

*Primary Examiner* — James Goloboy

(74) *Attorney, Agent, or Firm* — Oblon, McClelland, Maier & Neustadt, L.L.P.

(57) ABSTRACT

A shock absorber oil composition of the invention includes a base oil: (A) at least one of phosphate, amine phosphate salt, phosphite and amine phosphite salt; (B) an amide compound; and (C) an N-substituted derivative of sarcosine.

5 Claims, No Drawings

SHOCK ABSORBER OIL COMPOSITION

REFERENCE TO PRIOR APPLICATIONS

This application is a Continuation application of U.S. Ser. No. 14/373,783, now pending; which is a 371 of PCT/JP2012/082428, filed Dec. 13, 2012. Priority to Japanese patent application 2012-018842, filed Jan. 31, 2012, is claimed. All of the above applications are incorporated herein by reference in their entireties.

TECHNICAL FIELD

The present invention relates to a shock absorber oil composition.

BACKGROUND ART

As a shock absorber used for effectively absorbing vibration, for instance, a hydraulic shock absorber is widely used in an automobile or the like. The shock absorber is a functional component that plays an important role for vehicle handling, stability and ride quality, especially for ride quality.

Accordingly, there has been proposed a technology for particularly improving ride quality during travel on an expressway by improving friction characteristics of a shock absorber oil composition used in a shock absorber (Patent Literature 1).

CITATION LIST

Patent Literature(s)

Patent Literature 1: JP-A-2000-119677

SUMMARY OF THE INVENTION

Problems to be Solved by the Invention

However, the shock absorber oil composition disclosed in Patent Literature 1 transmits a rough vibration to a vehicle body during travel at a low speed, which may cause an insufficient ride quality.

An object of the invention is to provide a shock absorber oil composition providing an excellent ride quality during travel.

Means for Solving the Problems

In order to solve the above-mentioned problem, according to the invention, a shock absorber oil composition as follows is provided.

Specifically, a shock absorber oil composition according to an aspect of the invention includes: a base oil: a component (A) that is at least one of phosphate, amine phosphate salt, phosphite and amine phosphite salt; a component (B) that is an amide compound; and a component (C) that is an N-substituted derivative of sarcosine.

In the shock absorber oil composition according to the above aspect of the invention, it is preferable that the component (A) has an alkyl group or an alkenyl group, and the alkyl group or the alkenyl group has 12 to 20 carbon atoms.

In the shock absorber oil composition according to the above aspect of the invention, it is preferable that the component (B) has an alkyl group, and the alkyl group has 12 to 20 carbon atoms.

In the shock absorber oil composition according to the above aspect of the invention, it is preferable that an N-substituent in the component (C) has 12 to 20 carbon atoms.

In the shock absorber oil composition according to the above aspect of the invention, it is preferable that a content of the component (A) is in a range of 0.1 mass % to 1 mass % of a total amount of the composition, a content of the component (B) is in a range of 0.1 mass % to 1 mass % of the total amount of the composition, and a content of the component (C) is in a range of 0.1 mass % to 1 mass % of the total amount of the composition.

According to the above aspect of the invention, a shock absorber oil composition providing an excellent ride quality during travel can be provided.

DESCRIPTION OF EMBODIMENT(S)

A shock absorber oil composition of the invention (hereinafter, also referred to as "the composition") is provided by blending to a base oil: (A) at least one of phosphate, amine phosphate salt, phosphite and amine phosphite salt; (B) an amide compound; and (C) an N-substituted derivative of sarcosine. The composition of the invention will be described in detail below.

The base oil used in the composition may be a mineral lubricating base oil or a synthetic lubricating base oil. The kind of the lubricating base oil is not particularly limited but may be suitably selected from any mineral oil and synthetic oil that have been conventionally used as a base oil of a shock absorber oil.

Examples of the mineral lubricating base oil include a paraffinic mineral oil and a naphthenic mineral oil. Examples of the lubricating base oil include polybutene, polyolefin, polyol ester, diacid ester, phosphate, polyphenyl ether, polyglycol, alkyl benzene, and alkyl naphthalene. Examples of the polyolefin include an α-olefin homopolymer and an α-olefin copolymer. One of the above base oils may be singularly used or a combination of two or more thereof may be used.

A component (A) used in the composition is at least one of phosphate, amine phosphate salt, phosphite and amine phosphite salt. The component (A) preferably has an alkyl group or an alkenyl group. The alkyl group or alkenyl group preferably has 12 to 20 carbon atoms in terms of a friction coefficient between metals in the composition Examples of the alkyl group include a lauryl group, myristyl group, cetyl group, and stearyl group. The alkenyl group is exemplified by an oleyl group. Examples of the component (A) include acidic phosphate of alcohol lauryl alcohol and oleyl alcohol) and phosphoric acid, an amine salt of the acidic phosphate, phosphite of alcohol (e.g., lauryl alcohol and oleyl alcohol) and phosphorous acid, and an amine salt of the phosphite. One of the components (A) may be singularly used or a combination of two or more thereof may be used.

A content of the component (A) is not particularly limited, but is preferably in a range of 0.1 mass % to 1 mass % of a total amount of the composition, more preferably in a range of 0.3 mass % to 0.7 mass %. When the content of the component (A) is excessively small, the composition tends to exhibit a high friction coefficient between metals during travel at a low speed. On the other hand, when the content of the component (A) is excessively large, an undissolved portion of the component (A) is left, which may not always provide advantageous effects for the content.

A component (B) used in the composition is an amide compound. The component (B) preferably has an alkyl group. The alkyl group preferably has 12 to 20 carbon atoms in terms of the friction coefficient between metals in the composition. Examples of the component (B) include lauric acid amide, myristic acid amide, palmitic acid amide and stearic acid amide. One of the components (B) may be singularly used or a combination of two or more thereof may be used.

A content of the component (B) is not particularly limited, but is preferably in a range of 0.1 mass % to 1 mass % of the total amount of the composition, more preferably in a range of 0.3 mass % to 0.7 mass %. When the content of the component (B) is excessively small, the composition tends to exhibit a high friction coefficient between metals during travel at a low speed. On the other hand, when the content of the component (B) is excessively large, an undissolved portion of the component (B) is left, which may not always provide advantageous effect for the content.

A component (C) used in the composition is an N-substituted derivative of sarcosine. An N-substituent in the component (C) preferably has 12 to 20 carbon atoms in terms of a friction coefficient between metals in the composition. Examples of the N-substituent include an alkyl group and an alkenyl group. Examples of the component (C) include N-oleylsarcosine (N-oleoylsarcosine), N-lauroylsarcosine, N-myristoylsarcosine, and N-pahnitoylsarcosine. One of the components (C) may be singularly used or a combination of two or more thereof may be used.

A content of the component (C) is not particularly limited, but is preferably in a range of 0.1 mass % to 1 mass % of the total amount of the composition, more preferably in a range of 0.3 mass % to 0.7 mass %. When the content of the component (C) is excessively small, the composition tends to exhibit a high friction coefficient between metals during travel at a low speed. On the other hand, when the content of the component (C) is excessively large, an undissolved portion of the component (C) is left, which may not always provide advantageous effect for the content.

The composition satisfying the following conditions (i) to (iii) can be obtained by blending the components (A), (B) and (C) to the base oil.

(i) A friction coefficient between metals at a speed of 10 mm/s (a high-speed intermetal friction coefficient μ) is preferably 0.12 or less, more preferably in a range of 0.1 to 0.115.

(ii) A friction coefficient between metals at a speed of 0.3 mm/s (a low-speed intermetal friction coefficient μ) is preferably 0.11 or less, more preferably in a range of 0.08 to 0.1.

(iii) A ratio between the friction coefficients between metals (the low-speed intermetal friction coefficient μ/the high-speed intermetal friction coefficient μ) is preferably 0.95 or less, more preferably in a range of 0.8 to 0.9.

When the high-speed intermetal friction coefficient μ, the low-speed intermetal friction coefficient μ, and the ratio between the friction coefficients between metals (low-speed intermetal friction coefficient μ/high-speed intermetal friction coefficient μ) satisfy the above conditions, a movement of expansion and contraction of the shock absorber becomes smooth. Accordingly, the shock absorber can efficiently absorb vibration during travel (particularly during travel at a low speed). Thus, it is speculated that a shock absorber oil composition providing an excellent ride quality during travel is obtainable.

A measuring method of the friction coefficient between metals at the speed of 10 mm/s (high-speed intermetal friction coefficient p.) and the friction coefficient between metals at the speed of 0.3 mm/s (low-speed intermetal friction coefficient μ) will be shown in a later-described Example.

The composition may further contain various additives below as long as the advantageous effects of the invention are not impaired. Specifically, a viscosity index improver, pour point depressant, detergent dispersant, antioxidant, antiwear agent/extreme pressure agent, friction reducing agent, metal deactivator, rust inhibitor, surfactant/anti-emulsifier, antifoaming agent, anticorrosive agent, friction modifier, oiliness agent, acid scavenger and the like may be suitably blended to be used.

Examples of the viscosity index improver include a non-dispersed polymethacrylate, dispersed polymethacrylate, olefin copolymer, dispersed olefin copolymer and styrene copolymer. As a mass average molecular weight of the viscosity index improver, for instance, dispersed and non-dispersed polymethacrylates preferably each have a mass average molecular weight in a range of 5000 to 300000. The olefin copolymer preferably has a mass average molecular weight in a range of 800 to 100000. One of the viscosity index improvers may be singularly used or a combination of two or more thereof may be used.

A content of the viscosity index improver is not particularly limited, but is preferably in a range of 0.5 mass % to 15 mass % of the total amount of the composition, more preferably in a range of 1 mass % to 10 mass %.

The pour point depressant is exemplified by polymethacrylate having a mass average molecular weight in a range of 5000 to 50000. One of the pour point depressants may be singularly used or a combination of two or more thereof may be used.

A content of the pour point depressant is not particularly limited, but is preferably in a range of 0.1 mass % to 2 mass % of the total amount of the composition, more preferably in a range of 0.1 mass % to 1 mass %.

As the detergent dispersant, an ashless dispersant and a metal-base detergent may be used.

Examples of the ashless dispersant include a succinimide compound, a boron-based imide compound, and a Mannich dispersant. One of the ashless dispersants may be singularly used or a combination of two or more thereof may be used. A content of the ashless dispersant is not particularly limited, but is preferably in a range of 0.1 mass % to 20 mass % of the total amount of the composition.

Examples of the metal-base detergent include alkali metal sulfonate, alkali metal phenate, alkali metal salicylate, alkali metal naphthenate, alkaline earth metal sulfonate, alkaline earth metal phenate, alkaline earth metal salicylate, and alkaline earth metal naphthenate. One of the metal-base detergents may be singularly used or a combination of two or more thereof may be used. A content of the metal-base detergent is not particularly limited, but is preferably in a range of 0.1 mass % to 10 mass % of the total amount of the composition.

Examples of the antioxidant include an amine antioxidant, a phenol antioxidant, and a sulfur antioxidant. One of the antioxidants may be singularly used or a combination of two or more thereof may be used.

A content of the antioxidant is not particularly limited, but is preferably in a range of 0.05 mass % to 7 mass % of the total amount of the composition.

The antiwear agent/extreme pressure agent is exemplified by a sulfur extreme pressure agent. Examples of the sulfur extreme pressure agent include an olefin sulfide, a sulfurized fat and oil, an ester sulfide, thiocarbonates, dithiocarbamates and polysulfides. One of the antiwear agents/the extreme pressure agents may be singularly used or a combination of two or more thereof may be used.

A content of the antiwear agent/the extreme pressure agent is not particularly limited, but is preferably in a range of 0.1 mass % to 20 mass % of the total amount of the composition.

Examples of the friction reducing agent include a fatty acid ester, fatty acid, aliphatic alcohol, aliphatic amine, and aliphatic ether. Specifically, the friction reducing agent includes at least one alkyl group or alkenyl group having 6 to 30 carbon atoms in a molecule. One of the friction reducing agents may be singularly used or a combination of two or more thereof may be used.

A content of the friction reducing agent is not particularly limited, but is preferably in a range of 0.01 mass % to 2 mass % of the total amount of the composition, more preferably in a range of 0.01 mass % to 1 mass %.

Examples of the metal deactivator include a benzotriazole metal deactivator, tolyltriazole metal deactivator, thiadiazole metal deactivator, and imidazole metal deactivator. One of the metal deactivators may be singularly used or a combination of two or more thereof may be used.

A content of the metal deactivator is not particularly limited, but is preferably in a range of 0.01 mass % to 3 mass % of the total amount of the composition, more preferably in a range of 0.01 mass % to 1 mass %.

Examples of the rust inhibitor include petroleum sulfonate, alkylbenzene sulfonate, dinonylnaphthalene sulfonate, alkenyl succinic ester and multivalent alcohol ester. One of the rust inhibitors may be singularly used or a combination of two or more thereof may be used.

A content of the rust inhibitor is not particularly limited, but is preferably in a range of 0.01 mass % to 1 mass % of the total amount of the composition, more preferably in a range of 0.05 mass % to 0.5 mass %. The surfactant/anti-emulsifier is exemplified by a polyalkylene glycol non-ionic surfactant. Specific examples of the surfactant/anti-emulsifier include polyoxyethylenealkylether, polyoxyethylenealkylphenylether, and polyoxyethylenealkylnaphthylether. One of the surfactants/anti-emulsifiers may be singularly used or a combination of two or more thereof may be used.

A content of the surfactant/anti-emulsifier is not particularly limited, but is preferably in a range of 0.01 mass % to 3 mass % of the total amount of the composition, more preferably in a range of 0.01 mass % to 1 mass %.

Examples of the antifoaming agent are silicone oil, fluorosilicone oil, and fluoroalkylether. One of the antifoaming agents may be singularly used or a combination of two or more thereof may be used.

A content of the antifoaming agent is not particularly limited, but is preferably in a range of 0.005 mass % to 0.5 mass % of the total amount of the composition, more preferably in a range of 0.01 mass % to 0.2 mass %.

Examples of the anticorrosive agent include a benzotriazole anticorrosive agent, a benzimidazole anticorrosive agent, a benzothiazole anticorrosive agent and a thiadiazole anticorrosive agent. One of the anticorrosive agents may be singularly used or a combination of two or more thereof may be used.

A content of the anticorrosive agent is not particularly limited, but is preferably in a range of 0.01 mass % to 1 mass % of the total amount of the composition.

Examples of the friction modifier include an organic molybdenum compound, fatty acid, higher alcohol, fatty acid ester, oils and fats, amine, and ester sulfide. One of the friction modifiers may be singularly used or a combination of two or more thereof may be used.

A content of the friction modifier is not particularly limited, but is preferably in a range of 0.01 mass % to 10 mass % of the total amount of the composition.

Examples of the oiliness agent include aliphatic monocarboxylic acid, polymerized fatty acid, hydroxy fatty acid, and aliphatic monoalcohol. One of the oiliness agents may be singularly used or a combination of two or more thereof may be used.

A content of the oiliness agent is not particularly limited, but is preferably in a range of 0.01 mass % to 10 mass % of the total amount of the composition.

As the acid scavenger, an epoxy compound may be used. Specific examples of the acid scavenger include phenyl glycidyl ether, alkyl glycidyl ether, alkylene glycol glycidyl ether, cyclohexene oxide, α-olefin oxide and epoxidized soybean oil. One of the acid scavengers may be singularly used or a combination of two or more thereof may be used.

A content of the acid scavenger is not particularly limited, but is preferably in a range of 0.005 mass % to 5 mass % of the total amount of the composition.

EXAMPLE

The invention will be described in more detail below with reference to Examples and Comparatives. It should be noted that the invention is not limited to the description of Examples and the like.

Examples 1 to 4 and Comparatives 1 to 2

Shock absorber oil compositions (sample oils) were prepared from the following materials according to the blending composition shown in Table 1. Properties of the sample oils and actual ride quality were evaluated according to the following methods.

(1) Friction Coefficient between Metals (at Low and High Speeds) and Ratio therebetween Friction coefficients between metals were measured under the following conditions using a reciprocating friction tester. A friction coefficient between metals at a speed of 10 mm/s (friction coefficient μ between metals at a high speed) and a friction coefficient between metals at a speed of 0.3 mm/s (low-speed intermetal friction coefficient μ) were measured. A ratio between the friction coefficients between metals (low-speed intermetal friction coefficient μ/high-speed intermetal friction coefficient μ) was calculated.

Test Ball: SUJ2 steel ball
Test Plate: SUJ2 steel plate
Oil temperature: 60 degrees C.
Load: 0.5 kgf
Speed: 10 mm/s (at a high speed), 0 3 mm/s (at a low speed)

(2) Actual Ride Quality Test

Vehicles provided with shock absorbers using the sample oils were prepared. Four drivers each conducted an actual ride quality test. The drivers respectively evaluated the vehicles on a five-point scale in terms of ten items including a ride feeling (a good ride quality), a hardness feeling (a beat feeling (i.e., a feeling on the foot sole and the hip when traveling on a cracked road surface and the like)), balance (a ride quality to keep the vehicle in balance), straight-running stability and the like. The obtained points were averaged to provide an evaluation point of the actual ride quality test. The ride quality is more superior as the point is higher Base Oil: Mineral oil (kinematic viscosity at 40 degrees C.: 8.02 $mm^2/s$)
Viscosity Index Improver: Polymethacrylate (weight average molecular weight: 140000)
Detergent Dispersant 1: Polybutenyl succinimide
Detergent Dispersant 2: Calcium sulfonate
Detergent Dispersant 3: Fatty acid amide (stearyl)
Antiwear Agent 1: Acidic phosphate amine salt (oleyl)
Antiwear Agent 2: Acidic phosphate amine salt (lauryl)
Antiwear Agent 3: Phosphite (oleyl)
Antiwear Agent 4: Phosphite (lauryl)
Oiliness Agent: Oleyl sarcosine

TABLE 1

| | | | Example 1 | Example 2 | Example 3 | Example 4 | Comp. 1 | Comp. 2 |
|---|---|---|---|---|---|---|---|---|
| Blending Composition (mass %) | | Base oil | 94.88 | 94.88 | 94.88 | 94.88 | 94.88 | 94.88 |
| | | Viscosity index improver | 2.20 | 2.20 | 2.20 | 2.20 | 2.20 | 2.20 |
| | | Detergent dispersant 1 | — | — | — | — | 0.50 | — |
| | | Detergent dispersant 2 | — | — | — | — | — | 0.50 |
| | Component (B) | Detergent dispersant 3 | 0.50 | 0.50 | 0.50 | 0.50 | — | — |
| | Component (A) | Antiwear agent 1 | 0.50 | — | — | — | 0.50 | 0.50 |
| | Component (A) | Antiwear agent 2 | — | 0.50 | — | — | — | — |
| | Component (A) | Antiwear agent 3 | — | — | 0.50 | — | — | — |
| | Component (A) | Antiwear agent 4 | — | — | — | 0.50 | — | — |
| | Component (C) | Oilness agent | 0.50 | 0.50 | 0.50 | 0.50 | 0.50 | 0.50 |
| | | Other additives | 1.42 | 1.42 | 1.42 | 1.42 | 1.42 | 1.42 |
| Properties and Evaluation | Friction coefficient between metals @ 10 mm/s | | 0.107 | 0.110 | 0.110 | 0.112 | 0.123 | 0.123 |
| | Friction coefficient between metals @ 0.3 mm/s | | 0.089 | 0.096 | 0.095 | 0.096 | 0.119 | 0.122 |
| | Ratio between friction coefficient between metals | | 0.832 | 0.873 | 0.864 | 0.857 | 0.967 | 0.992 |
| | Actual ride quality test | | 4.8 | 4.6 | 4.6 | 4.7 | 3.6 | 3.7 |

As is obvious from the results shown in Table 1, when the shock absorber oil compositions containing the components (A) to (C) were used (in Examples 1 to 4), the low-speed intermetal friction coefficient μ tended to be low while the ratio between the friction coefficients between metals (low-speed intermetal friction coefficient μ/high-speed intermetal friction coefficient μ) tended to be small, whereby an excellent ride quality during travel was confirmed.

In contrast, when the shock absorber oil compositions containing no component (B) were used (in Comparatives 1 to 2), the low-speed intermetal friction coefficient μ was high while the ratio between the friction coefficients between metals (low-speed intermetal friction coefficient μ/high-speed intermetal friction coefficient μ) was about 1, whereby a poor ride quality during travel was confirmed.

INDUSTRIAL APPLICABILITY

A shock absorber oil composition of the invention is suitable as a shock absorber oil composition used for a shock absorber (e.g., monotube and multi-tube types) of an automobile (e.g., a motorcycle and a four-wheel vehicle).

The invention claimed is:

1. A method, comprising absorbing vibrations with a shock absorber, said shock absorber comprising a shock absorber oil composition, wherein the shock absorber oil composition comprises:

a base oil;

0.3 mass % to 1.0 mass % of a component (A) that is at least one selected from the group consisting of an acidic phosphate of phosphoric acid and lauryl alcohol, an acidic phosphate of phosphoric acid and oleyl alcohol, an amine salt of acidic phosphate of phosphoric acid and lauryl alcohol, an amine salt of acidic phosphate of phosphoric acid and oleyl alcohol, a phosphite of phosphorous acid and lauryl alcohol, a phosphite of phosphorous acid and oleyl alcohol, an amine salt of the phosphite of phosphorous acid and lauryl alcohol, and an amine salt of the phosphite of phosphorous acid and oleyl alcohol;

0.5 mass % to 1.0 mass % of a component (B) that at least one amide compound selected from the group consisting of a lauric acid amide, a myristic acid amide, a palmitic acid amide and a stearic acid amide; and 0.3 mass % to 1.0 mass % of a component (C) that is at least one N-substituted derivative of sarcosine selected from the group consisting of N-oleoylsarcosine, N-lauroylsarcosine, N-myristoylsarcosine, and N-palmitoylsarcosine, wherein, during the absorbing, a high-speed intermetal friction coefficient in the shock absorber at a speed of 10 mm/s is from 0.107 to 0.112 and a low-speed intermetal friction coefficient in the shock absorber at a speed of 0.3 mm/s is from 0.089 to 0.096 and a ratio of the low-speed intermetal friction coefficient to the high-speed intermetal friction coefficient is in a range from 0.832 to 0.873.

2. The method according to claim 1, wherein the base oil is a paraffinic mineral oil or a naphthenic mineral oil.

3. The method according to claim 1, wherein the component (B) is a stearic acid amide.

4. The method according to claim 1, wherein the shock absorber oil composition further comprises at least one additive selected from the group consisting of a viscosity index improver, pour point depressant, detergent dispersant, antioxidant, antiwear agent/extreme pressure agent, friction reducing agent, metal deactivator, rust inhibitor, surfactant/anti-emulsifier, antifoaming agent, anticorrosive agent, friction modifier, oiliness agent, and acid scavenger.

5. The method according to claim 1, wherein the shock absorber oil composition further comprises a viscosity index improver, and a content of the viscosity index improver is in a range from 0.5 mass % to 15 mass % based on the total amount of the composition.

* * * * *